US011335248B1

(12) United States Patent
Huang et al.

(10) Patent No.: US 11,335,248 B1
(45) Date of Patent: May 17, 2022

(54) DISPLAY DEVICE AND PIXEL DRIVING CIRCUIT

(71) Applicant: AU Optronics Corporation, Hsin-Chu (TW)

(72) Inventors: Shu-Hao Huang, Hsin-Chu (TW); Hsien-Chun Wang, Hsin-Chu (TW); Sung-Yu Su, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/203,792

(22) Filed: Mar. 17, 2021

(30) Foreign Application Priority Data

Dec. 30, 2020 (TW) ..... 109146954

(51) Int. Cl.
*G09G 3/32* (2016.01)

(52) U.S. Cl.
CPC ..... *G09G 3/32* (2013.01); *G09G 2300/0819* (2013.01)

(58) Field of Classification Search
CPC ..... G09G 3/32; G09G 2300/0819
See application file for complete search history.

(56) References Cited

U.S. PATENT DOCUMENTS

| | | | | |
|---|---|---|---|---|
| 10,885,845 | B2 * | 1/2021 | Gai | G09G 3/3233 |
| 2007/0045620 | A1 * | 3/2007 | Park | G09G 3/3233 257/40 |
| 2011/0025671 | A1 | 2/2011 | Lee | |
| 2015/0243222 | A1 | 8/2015 | Lee | |
| 2016/0104419 | A1 * | 4/2016 | Chung | G09G 3/3225 345/78 |
| 2017/0243545 | A1 * | 8/2017 | Kang | G09G 3/3233 |
| 2019/0266946 | A1 | 8/2019 | Zhu et al. | |
| 2019/0385521 | A1 | 12/2019 | Mao | |

FOREIGN PATENT DOCUMENTS

| | | | |
|---|---|---|---|
| GN | 205282057 | U | 6/2016 |
| TW | 201415438 | A | 4/2014 |

* cited by examiner

*Primary Examiner* — Muhammad N Edun
(74) *Attorney, Agent, or Firm* — WPAT, PC

(57) ABSTRACT

A display device includes a pixel driving circuit including a data writing unit, a light emitting unit and a compensation unit. The data writing unit includes first and second capacitors. A first terminal of the first capacitor is coupled to a first node, and a second terminal of the first capacitor is coupled to a second node. A first terminal of the second capacitor is coupled to the first node. The light emitting unit includes a first switch and a light emitting element. A control terminal of the first switch is coupled to the second node, and a first terminal of the first switch is coupled to a second terminal of the second capacitor. The compensation unit includes a second switch. The second switch is coupled to the second node and a second terminal of the first switch.

20 Claims, 10 Drawing Sheets

200

500

600

DISPLAY DEVICE AND PIXEL DRIVING CIRCUIT

CROSS-REFERENCE TO RELATED APPLICATION

This application claims priority to Taiwan Application Serial Number 109146954, filed Dec. 30, 2020, which is herein incorporated by reference in its entirety.

BACKGROUND

Technical Field

The present disclosure relates to display technology. More particularly, the present disclosure relates to a display device and a pixel driving circuit.

Description of Related Art

During manufacturing processes, pixel driving circuits on a substrate of a display device may suffer from metal residue and excessive etching which cause substrate abnormalities. Manufacturing processes of light emitting elements, such as micro light emitting diodes, are complicated, resulting in higher costs. In addition, currents in conventional pixel driving circuits may be affected by the characteristics of switches and/or resistance on current paths which cause non-uniform brightness of a display.

SUMMARY

The present disclosure provides a display device. The display device includes pixel driving circuits coupled to each other in series. One of the pixel driving circuits includes a data writing unit, a light emitting unit and a compensation unit. The data writing unit is configured to write a data signal into a first node. The data writing unit includes a first capacitor and a second capacitor. A first terminal of the first capacitor is coupled to the first node, and a second terminal of the first capacitor is coupled to a second node. A first terminal of the second capacitor coupled to the first node. The light emitting unit is configured to generate a current according to the data signal. The light emitting unit includes a first switch and a light emitting element. The first switch is configured to receive the current, a control terminal of the first switch is coupled to the second node, and a first terminal of the first switch is coupled to a second terminal of the second capacitor. The light emitting element is configured to emit light according to the current. The compensation unit is configured to adjust a voltage level of the second node. The compensation unit includes a second switch. A first terminal of the second switch is coupled to the second node, and a second terminal of the second switch is coupled to a second terminal of the first switch.

The present disclosure provides a pixel driving circuit. The pixel driving circuit includes a first capacitor, a second capacitor, a first switch, a light emitting element, a second switch, a third switch and a fourth switch. A first terminal of the first capacitor is coupled to a first node, and a second terminal of the first capacitor is coupled to a second node. A first terminal of the second capacitor is coupled to the first node. The first switch is configured to receive a current, a control terminal of the first switch is coupled to the second node, and a first terminal of the first switch is coupled to a second terminal of the second capacitor. The light emitting element is configured to emit light according to the current.

A first terminal of the second switch is coupled to the second node, and a second terminal of the second switch is coupled to a second terminal of the first switch. A control terminal of the third switch is configured to receive a first scan signal, a first terminal of the third switch is coupled to the first node, and a second terminal of the third switch is configured to receive a first reference signal. A control terminal of the fourth switch is configured to receive a second scan signal different from the first scan signal, a first terminal of the fourth switch is coupled to the first node, and a second terminal of the fourth switch is coupled to the second terminal of the third switch.

The present disclosure provides a pixel driving circuit. The pixel driving circuit includes a first capacitor, a second capacitor, a first switch, a light emitting element, a second switch, a third switch, a fourth switch, a fifth switch and a sixth switch. A first terminal of the first capacitor is coupled to a first node, and a second terminal of the first capacitor is coupled to a second node. A first terminal of the second capacitor is coupled to the first node. A control terminal of the first switch is coupled to the second node, and a first terminal of the first switch is coupled to a second terminal of the second capacitor. A first terminal of the second switch is coupled to the second node, and a second terminal of the second switch is coupled to a second terminal of the first switch. A first terminal of the third switch is coupled to the first node. A first terminal of the fourth switch is coupled to the second node. A first terminal of the fifth switch is coupled to the second terminal of the second capacitor. A first terminal of the sixth switch is coupled to the second terminal of the first switch.

It is to be understood that both the foregoing general description and the following detailed description are by examples, and are intended to provide further explanation of the disclosure as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
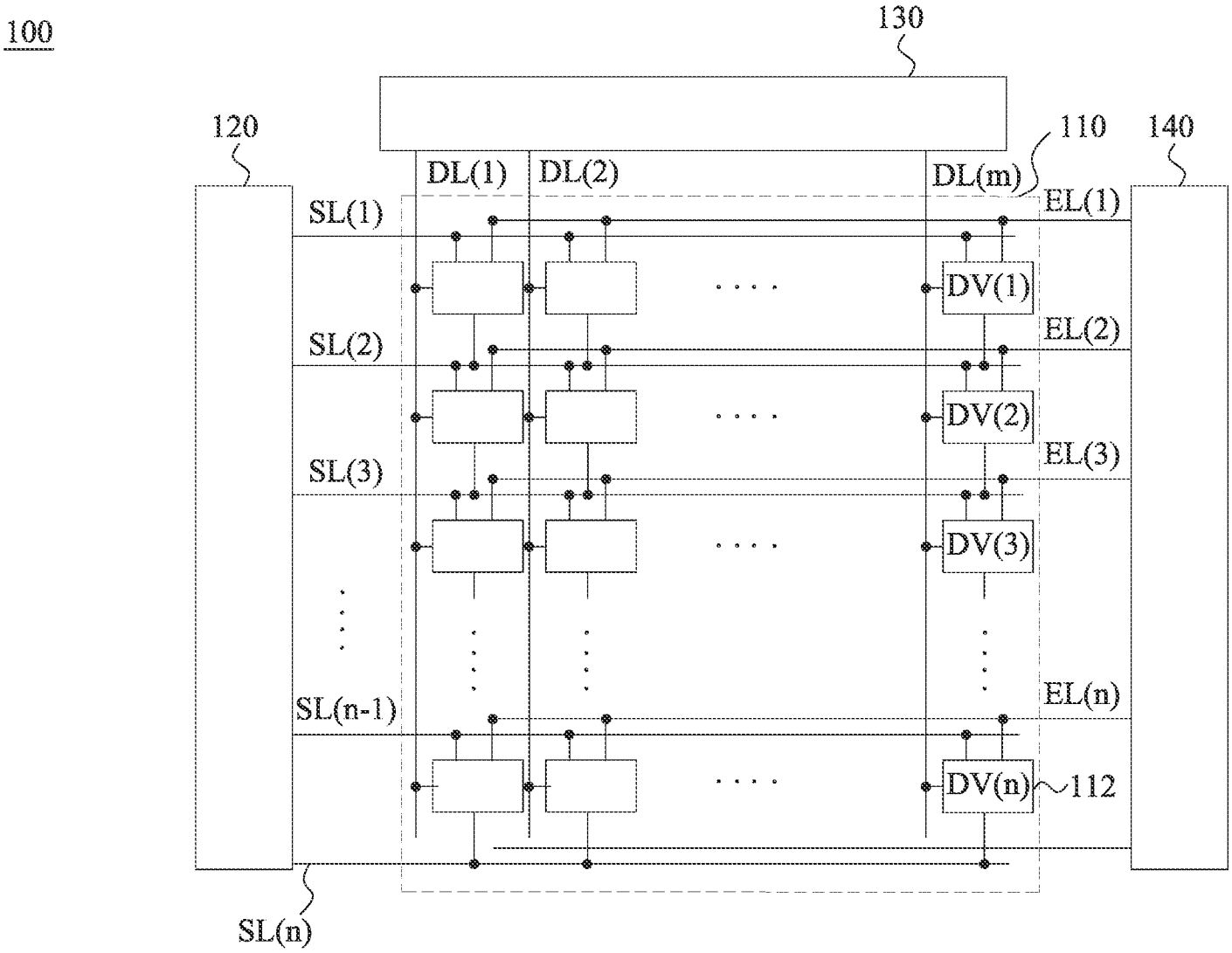
FIG. 1 is a schematic diagram of a display according to one embodiment of this disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The terms applied throughout the following descriptions and claims generally have their ordinary meanings clearly established in the art or in the specific context where each term is used. Those of ordinary skill in the art will appreciate that a component or process may be referred to by different names. Numerous different embodiments detailed in this specification are illustrative only, and in no way limit the scope and spirit of the disclosure or of any exemplified term.

It is worth noting that terms such as "first" and "second" used herein to describe various elements or processes aim to distinguish one element or process from another. However, the elements, processes and the sequences thereof should not be limited by these terms. For example, a first element could be termed as a second element, and a second element could be similarly termed as a first element without departing from the scope of the present disclosure.

In the following discussion and in the claims, the terms "comprising," "including," "containing," "having," "involving," and the like are to be understood to be open-ended, that is, to be construed as including but not limited to. As used herein, instead of being mutually exclusive, the term "and/or" includes any of the associated listed items and all combinations of one or more of the associated listed items.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic diagram of a display according to one embodiment of this disclosure. As illustratively shown in FIG. 1, a display 100 includes a display device 110, a scan device 120, a data input device 130 and a light emitting controlling device 140. The scan device 120 is configured to provide scan signals, such as scan signals S(n−2), S(n−1) and S(n) shown in FIG. 2, to the display device 110 by scan lines SL(0)-SL(n). The data input device 130 is configured to provide data signals, such as a data signal DT shown in FIG. 2, to the display device 110 by data lines DL(0)-DL(m). The light emitting controlling device 140 is configured to provide light emitting signals, such as a light emitting signal EM shown in FIG. 2, to the display device 110 by light emitting lines EL(0)-EL(n). It is noted that n and m are positive integers. In some embodiments, the display 100 can be manufactured by a glass substrate or a plastic substrate, but the present disclosure is not limited to such embodiments.

As illustratively shown in FIG. 1, the display device 110 includes multiple stages of pixel driving circuits DV(1)-DV(n) coupled in series with each other. The pixel driving circuits DV(1)-DV(n) include a pixel driving circuit 112. In some embodiments, the pixel driving circuit 112 included in the display device 110 performs a light emitting operation according to the signals provided by the scan device 120, the data input device 130 and the light emitting controlling device 140.

Figure 2:
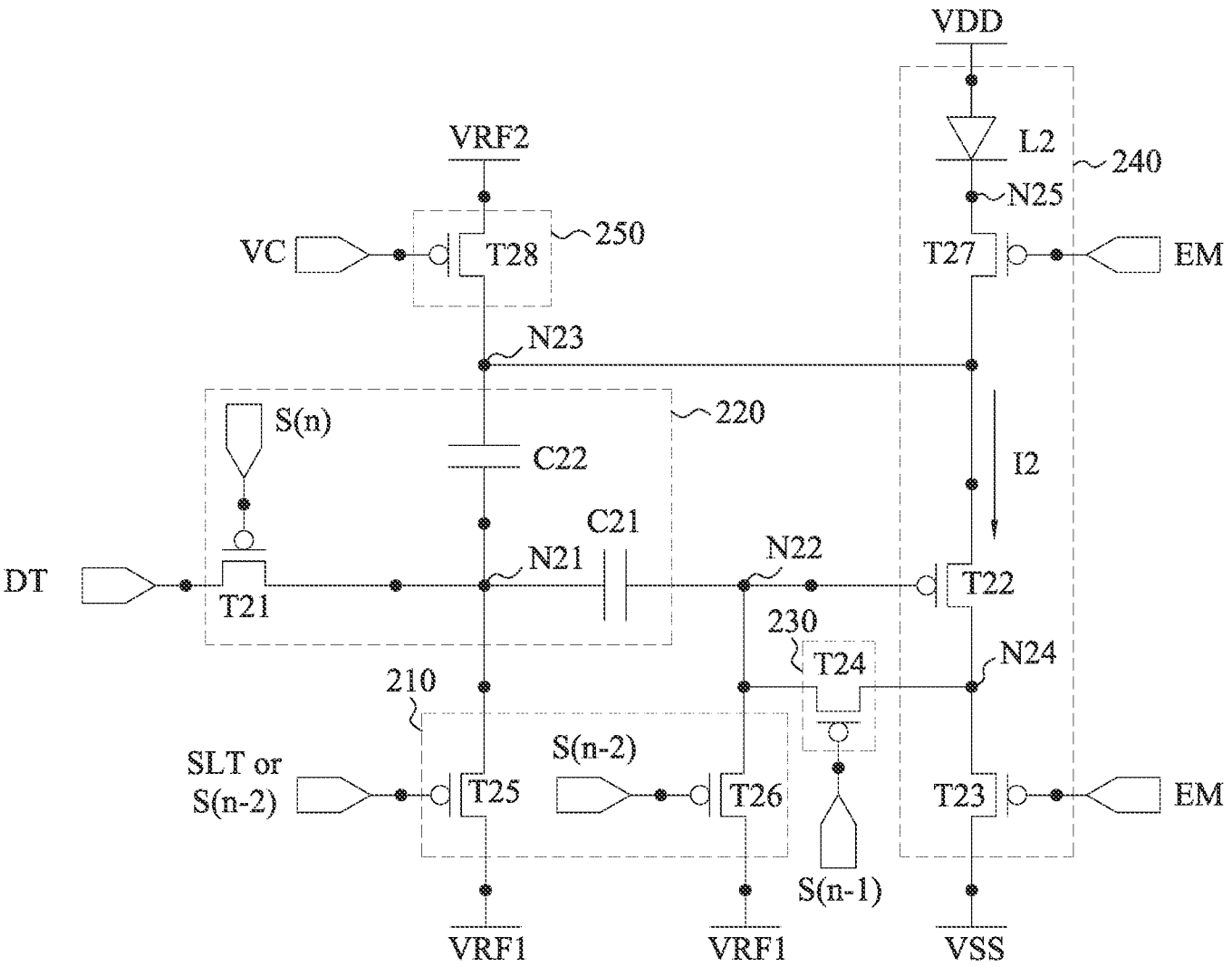
FIG. 2 is a circuit diagram of a pixel driving circuit in a display device according to one embodiment of this disclosure.

For example, a pixel driving circuit 200 shown in FIG. 2 is an embodiment of the pixel driving circuit 112. As illustratively shown in FIG. 2, the pixel driving circuit 200 is reset by the scan signals S(n−2), S(n−1) and S(n) provided by the scan device 120, and writes the data signal DT provided by the data input device 130. A voltage level of the data signal DT determines a brightness of the light emitting element L2. A light emitting duration of the light emitting element L2 is controlled by the light emitting signal EM provided by the light emitting controlling device 140.

In some embodiments, the scan signals S(n−1) and S(n) are transmitted to the pixel driving circuit 112 through the scan lines SL(n−1) and SL(n), respectively. The data signal DT is transmitted to the pixel driving circuit 112 through the data line DL(m). The light emitting signal EM is transmitted to the pixel driving circuit 112 through the light emitting line EL(n). The present disclosure is not limited to the embodiments described above. Various methods of transmitting the scan signals S(n−1), S(n), the data signal DT and the light emitting signal EM are contemplated as being within the scope of the present disclosure.

FIG. 2 is a circuit diagram of the pixel driving circuit 200 in the display device 110 according to one embodiment of this disclosure. The pixel driving circuit 200 is an embodiment of the pixel driving circuit 112 in the display device 110.

As illustratively shown in FIG. 2, the pixel driving circuit 200 includes a reset unit 210, a data writing unit 220, a compensation unit 230, light emitting unit 240 and a stabilizing unit 250.

As illustratively shown in FIG. 2, the reset unit 210 is configured to perform a reset operation according to the scan signal S(n−2), to reset voltage levels of nodes N21 and N22. In other embodiments, such as the embodiment illustratively shown in FIG. 4, the reset unit 210 is further configured to perform a reset operation according to a voltage signal SLT.

As illustratively shown in FIG. 2, the data writing unit 220 is configured to perform a data writing operation according to the scan signal S(n), to write the data signal DT into the node N21.

As illustratively shown in FIG. 2, the compensation unit 230 is configured to adjust a voltage level of the node N22 according to the scan signal S(n−1). For example, the compensation unit 230 writes a threshold voltage level $V_{TH}$ into the node N22 to perform a compensating operation.

As illustratively shown in FIG. 2, the light emitting unit 240 is configured to perform a light emitting operation according to the light emitting signal EM, generate a current 12 according to the voltage level of the node N22, and emit light according to a current level of the current 12.

As illustratively shown in FIG. 2, the stabilizing unit 250 is configured to transmit a reference signal VRF2 to a node N23 according to the light emitting signal EM, to reset a voltage level of the node N23 and stabilize the voltage level of the node N21.

In some embodiments, the pixel driving circuit 200 is an nth stage pixel driving circuit DV(n) of the pixel driving circuits in the display 100. Accordingly, the scan signal S(n) is an nth stage scan signal, the scan signal S(n−1) is an (n−1)th stage scan signal, and the scan signal S(n−2) is an (n−2)th stage scan signal. An (n−1)th stage pixel driving circuit DV(n−1) of the pixel driving circuits in the display 100 is configured to perform a data writing operation according to the scan signal S(n−1). An (n−2)th stage pixel driving circuit DV(n−1) in the display 100 is configured to perform a data writing operation according to the scan signal S(n−2).

As illustratively shown in FIG. 2, the reset unit 210 includes switches T25 and T26. A control terminal of the switch T26 is configured to receive the scan signal S(n−2), a terminal of the switch T26 is coupled to the node N22, and another terminal of the switch T26 is configured to receive a reference signal VRF1. A terminal of the switch T25 is coupled to the node N21, and another terminal of the switch T25 is configured to receive the reference signal VRF1. In different embodiments, a control terminal of the switch T25 is configured to receive the scan signal S(n−2) (corresponding to the embodiment shown in FIG. 3) or a voltage signal SLT (corresponding to the embodiment shown in FIG. 4).

As illustratively shown in FIG. 2, the data writing unit 220 includes a switch T21, and capacitors C21 and C22. A control terminal of the switch T21 is configured to receive the scan signal S(n), a terminal of the switch T21 is configured to receive the data signal DT, and another terminal of the switch T21 is coupled to the node N21. A terminal of the capacitor C21 is coupled to the node N21, and another terminal of the capacitor C21 is coupled to the node N22. A terminal of the capacitor C22 is coupled to the node N21, and another terminal of the capacitor C22 is coupled to the node N23.

As illustratively shown in FIG. 2, the compensation unit 230 includes a switch T24. A control terminal of the switch T24 is configured to receive the scan signal S(n−1), a terminal of the switch T24 is coupled to the node N22, and another terminal of the switch T24 is coupled to the light emitting unit 240 at a node N24.

As illustratively shown in FIG. 2, the light emitting unit 240 includes the light emitting element L2, and switches T22, T23 and T27. A control terminal of the switch T22 is coupled to the node N22, a terminal of the switch T22 is coupled to the node N24, and another terminal of the switch T22 is coupled to the node N23. A control terminal of the switch T23 is configured to receive the light emitting signal EM, a terminal of the switch T23 is coupled to the node N24, and another terminal of the switch T23 is configured to receive a voltage signal VSS. A control terminal of the switch T27 is configured to receive the light emitting signal EM, a terminal of the switch T27 is coupled to the light emitting element L2 at a node N25, and another terminal of the switch T27 is coupled to the node N23. A terminal of the light emitting element L2 is coupled to the node N25, and another terminal of the light emitting element L2 is configured to receive a voltage signal VDD. In some embodiments, the light emitting element L2 is configured to receive the current 12 passing through the switch T22, and configured to emit light according to the current 12.

As illustratively shown in FIG. 2, the stabilizing unit 250 includes a switch T28. A control terminal of the switch T28 is configured to receive a control signal VC, a terminal of the switch T28 is coupled to the node N23, and another terminal of the switch T28 is configured to receive a reference signal VRF2.

In different embodiments, the light emitting element L2 can be implemented by a micro light emitting diode (mLED) or another type of light emitting element. In different embodiments, the switches T21-T28 can be implemented by p-type metal-oxide-semiconductor field-effect transistors (PMOS), n-type metal-oxide-semiconductor field-effect transistors (NMOS), thin film transistors (TFT) or other types of switching elements.

Figure 3:
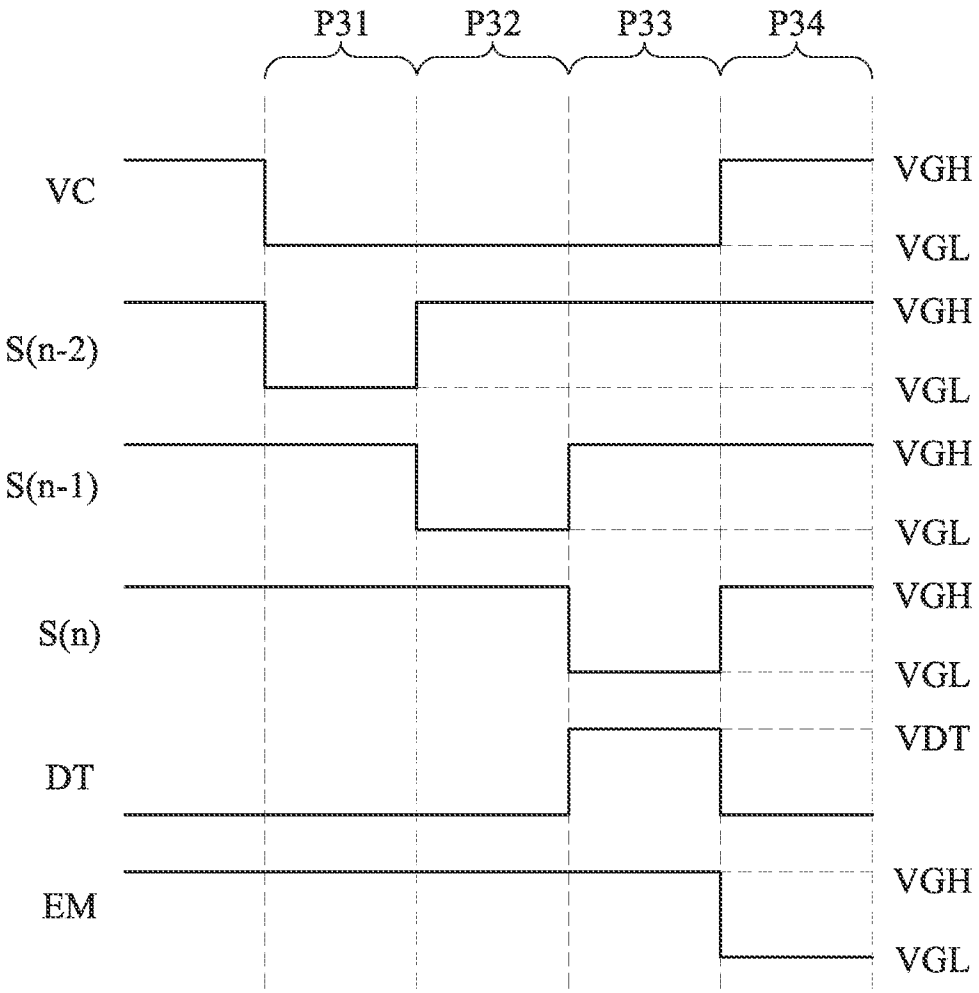
FIG. 3 is a timing diagram of the pixel driving circuit performing a driving operation according to one embodiment of this disclosure.

FIG. 3 is a timing diagram of the pixel driving circuit 200 performing a driving operation according to one embodiment of this disclosure. The timing diagram illustratively shown in FIG. 3 includes periods P31-P34 in order. In some embodiments, the timing diagram shown in FIG. 3 corresponds to signals shown in FIG. 2, such as operations of the scan signals S(n−2), S(n−1) and S(n), the light emitting signal EM, the data signal DT and the control signal VC. In the embodiment shown in FIG. 3, the control terminal of the switch T25 is configured to receive the scan signal S(n−2).

As illustratively shown in FIG. 3, during the period P31, the control signal VC has an enable voltage level VGL, such that the switches T25, T26 and T28 are turned on. At this time, the switches T25 and T26 provide the reference signal VRF1 having a voltage level RF1 to the nodes N21 and N22, respectively, such that the nodes N21 and N22 have the voltage level RF1. The switch T28 provides the reference signal VRF2 having a voltage level RF2 to the node N23, such that the node N23 has the voltage level RF2.

In some embodiments, the voltage level RF1 is an enable voltage level, such that the switch T22 is turned on according to the voltage level RF1 of the node N21. In some embodiments, the capacitor C21 is configured to store charges of the node N21 to maintain the voltage level of the node N21 after the switch T26 is turned off, such that the switch T22 continues to be turned on after the switch T26 is turned off, such as during the period P32.

In some embodiments, during the period P31, the voltage levels of the nodes N21, N22 and N23 are reset by the reference signals VRF1 and VRF2, such that the pixel driving circuit 200 is prepared to receive the data signal DT, and thus the period P31 is referred to as a reset period.

During the period P32, the scan signal S(n−1) and the control signal VC have the enable voltage level VGL, such that the switches T24 and T28 are turned on. The scan signal S(n−2) has a disable voltage level VGH, such that the switches T25 and T26 are turned off. The switch T28 provides the reference signal VRF2 to the node N23, such that the node N23 has the voltage level RF2. Due to the charges stored by the capacitor C21 during the period P31, the node N22 still has an enable voltage level during the period P32, and thus the switch T22 is turned on during the period P32. In some embodiments, the voltage level RF2 of the reference signal VRF2 is higher than the voltage level RF1 of the node N22, such that a current flows from the node N23, through the switches T22 and T24 in order, and to the node N22. At this time, the reference signal VRF2 is written into the node N22 through the switches T28, T22 and T24 in order, such that the voltage level of the node N22 is pulled to (RF2-$|V_{TH}|$), in which the threshold voltage level $V_{TH}$ is the threshold voltage level of the switch T22. At this time, the voltage level of the node N21 is determined by the voltage level RF2 of the node N23, the voltage level (RF2-$|V_{TH}|$) of the node N22, and the voltage level RF1 of the node N21 during the period P31.

As illustratively shown in FIG. 2, the capacitors C21 and C22 are coupled to each other in series. During the period P32, according to a formula of capacitors coupled in series, the voltage level of the node N21 can be calculated as (RF1+((RF2−$|V_{TH}|$−RF1)×(CV21/(CV21+CV22))). The capacitor values CV21 and CV22 are the capacitor values of the capacitors C21 and C22, respectively. In some embodiments, the capacitor value CV22 is much larger than the capacitor value CV21. For example, the capacitor value CV22 is more than ten times larger than the capacitor value CV21. As a result, the term (CV21/(CV21+CV22)) approaches zero, and thus the voltage level of the node N21 can be considered to be equal to the voltage level RF1.

In some embodiments, during the period P32, the voltage level of the node N22 is adjusted to (RF2−$|V_{TH}|$) in preparation of compensating for the threshold voltage level $V_{TH}$ of the switch T22 during a light emitting period, such as the period P34. Accordingly, the period P32 is referred to as a compensating period.

In some previous approaches, the voltage signal configured to perform compensation is affected by an internal resistance of the circuit element of the pixel driving circuit, and thus suffers from a voltage drop (IR drop), such that the voltage levels of the nodes in the pixel driving circuit are not stable.

Compared to the above approaches, in some embodiments of the present disclosure, the switch T28 transmits the reference signal VRF2 which is not affected by an IR drop to the node N23, and further stabilizes the voltage level of the node N21 by the capacitor C22.

During the period P33, the scan signal S(n) and the control signal VC have the enable voltage level VGL, such that the switches T21 and T28 are turned on. The scan signal S(n−1) has a disable voltage level VGH, such that the switch T24 is turned off. The switch T28 provides the reference signal VRF2 to the node N23, such that the node N23 has the voltage level RF2. At this time, the switch T21 writes the data signal DT having a voltage level VDT into the node N21, such that the voltage level of the node N21 is pulled to the voltage level VDT. The capacitor C21 writes the voltage level VDT of the node N21 into the node N22, to pull the voltage level of the node N22 to (RF2-$|V_{TH}|$+(VDT-RF1)). At this time, a voltage level difference VGS between the nodes N22 and N23 is (VDT-RF1-$|V_{TH}|$).

In some embodiments, during the period P33, the switch T21 and the capacitor C21 write the data signal DT into the node N22. Accordingly, the period P33 is referred to as a data writing period.

During the period P34, the light emitting signal EM has the enable voltage level VGL, such that the switches T23 and T27 are turned on. The scan signal S(n) and the control signal VC have a disable voltage level VGH, such that the switches T21 and T28 are turned off. At this time, the voltage signal VDD having a voltage level DD pulls the voltage level of the node N23 to (DD-VLED-VT27) through the light emitting element L2 and the switch T27. The voltage level differences VLED and VT27 correspond to the voltage level differences generated when the voltage signal VDD passes through the light emitting element L2 and the switch T27, respectively. Accordingly, the voltage level of the node N22 is pulled to (VDT-RF1-$|V_{TH}|$+(DD-VLED-VT27)) by the capacitors C21 and C22. At this time, the voltage level difference VGS between the nodes N22 and N23 is (VDT-RF1-$|V_{TH}|$).

During the period P34, the current 12 flows through the light emitting element L2, and the switches T27, T22 and T23 in order, such that the light emitting element L2 emits light according to the current level of the current 12. In some embodiments, the current level of the current 12 determines the brightness of the light emitting element L2.

In some embodiments, the current level of the current 12 is determined by the voltage level difference between a gate terminal and a source terminal of the switch T22, which is the voltage level difference VGS between the nodes N22 and N23. It may be determined utilizing formulas in electronics that the current 12 passing through the switch T22 has a current level K×(VGS+$|V_{TH}|$)^2. During the period P34, the voltage level difference VGS is (VDT-RF1−$|V_{TH}|$). K is a constant. As a result, the current level of the current 12 is independent from the threshold voltage level $V_{TH}$, while it is dependent upon the voltage level DT of the data signal DT and the voltage level RF1 of the reference signal VRF1.

In some embodiments, during the period P34, the light emitting element L2 of the pixel driving circuit 200 emits light, and thus the period P34 is referred to as a light emitting period.

In some previous approaches, when the current passes through different paths in the display, different resistance values on the different paths cause different voltage drops. In addition, the threshold voltage levels of the switches also cause voltage drops. The current passing through the light emitting element is hard to control, such that the brightness of the display is not uniform.

Compared to the above approaches, in some embodiments of the present disclosure, the voltage levels VDT and RF1 are determined by users. As a result, the current 12 passing through the light emitting element L2 can be adjusted by the users, and is therefore prevented from being affected by current paths, or element features of the pixel driving circuit, such as the threshold voltage $V_{TH}$ of the switch T22.

In other embodiments, the pixel driving circuit 200 does not perform compensation of the threshold voltage level $V_{TH}$ of the switch T22. As described in relation to the operation of the pixel driving circuit 200 during the period P32, the voltage level RF2 of the reference signal VRF2 is higher than the voltage level RF1 of the node N22, such that the switches T22 and T24 perform the compensating operation by writing the threshold voltage level $V_{TH}$ into the node N22 with the reference signal VRF2. In contrast, when the user adjusts the voltage level of the reference signal VRF2 to be lower than or equal to the voltage level RF1, the threshold voltage level $V_{TH}$ is not written into the node N22, such that compensation of the threshold voltage level $V_{TH}$ of the switch T22 does not occur. As a result, during the following period P34, the voltage level difference VGS is (VDT-RF1), and the current level of the current 12 is K×(VDT-RF1+$|V_{TH}|$)^2. In different embodiments, the compensating function of the pixel driving circuit 200 can be turned on or turned off by different voltage levels of the reference signal VRF2.

Figure 4:
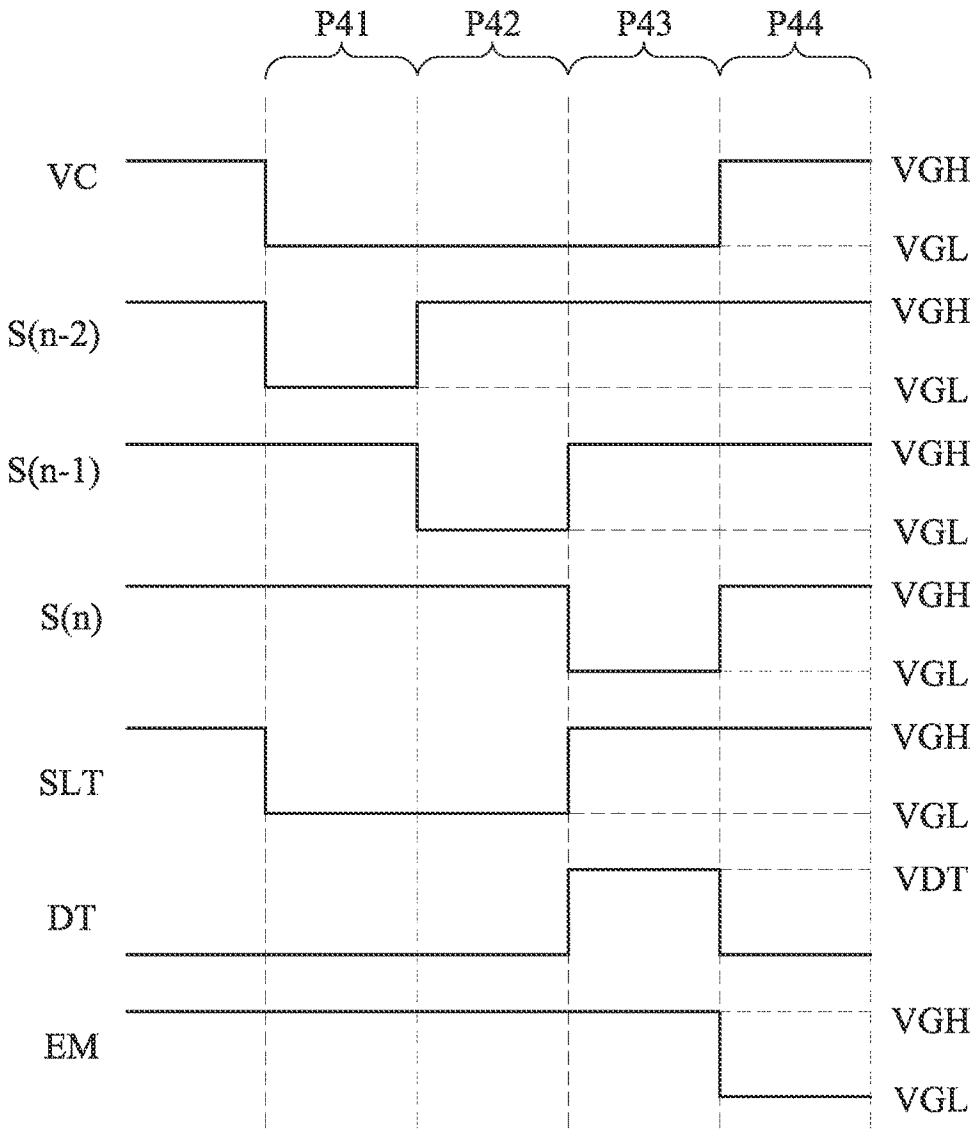
FIG. 4 is a timing diagram of the pixel driving circuit performing a driving operation according to one embodiment of this disclosure.

FIG. 4 is a timing diagram of the pixel driving circuit 200 performing a driving operation according to one embodiment of this disclosure. The timing diagram illustratively shown in FIG. 4 includes periods P41-P44 in order. In some embodiments, the timing diagram shown in FIG. 4 corresponds to signals shown in FIG. 2, such as operations of the scan signals S(n−2), S(n−1) and S(n), the light emitting signal EM, the voltage signal SLT, the data signal DT and the control signal VC. In the embodiment shown in FIG. 4, the control terminal of the switch T25 is configured to receive the voltage signal SLT.

Referring to FIG. 3 and FIG. 4, operations of the pixel driving circuit 200 during the periods P41-P44 are similar to the operations during the periods P31-P34, and thus similar aspects of these operations are not repeated for brevity.

As illustratively shown in FIG. 4, during the period P41, the voltage signal SLT has an enable voltage level VGL, such that the switch T25 is turned on. At this time, the switch T25 provides the reference signal VRF1 having a voltage level RF1 to the node N21, such that the node N21 has the voltage level RF1.

During the period P42, the voltage signal SLT, the scan signal S(n−1) and the control signal VC have the enable voltage level VGL, such that the switches T25, T24 and T28 are turned on. The scan signal S(n−2) has a disable voltage level VGH, such that the switch T26 is turned off. The switch T28 provides the reference signal VRF2 to the node N23, such that the node N23 has the voltage level RF2 and the node N22 has a voltage level (RF2−$|V_{TH}|$). The switch T25 provides the reference signal VRF1 having a voltage level RF1 to the node N21, such that the node N21 has the voltage level RF1.

During the period P43, when the switch T21 writes the data signal DT into the node N21, the capacitor C21 writes a voltage level difference between the voltage levels RF1 and VDT into the node N22 for the data writing operation. At this time, the voltage level of the node N22 is (RF2−$|V_{TH}|$+(VDT−RF1)).

Referring to FIG. 3 and FIG. 4, operations of the switch T25 receiving the voltage signal SLT during the periods P43 and P44 are similar to the operations of the switch T25 receiving the scan signal S(n−2) during the period P33 and P34, and thus similar aspects of these operations are not repeated for brevity. In different embodiments, the switch T25 can receive the voltage signal SLT or the scan signal S(n−2) to perform operations.

Figure 5:
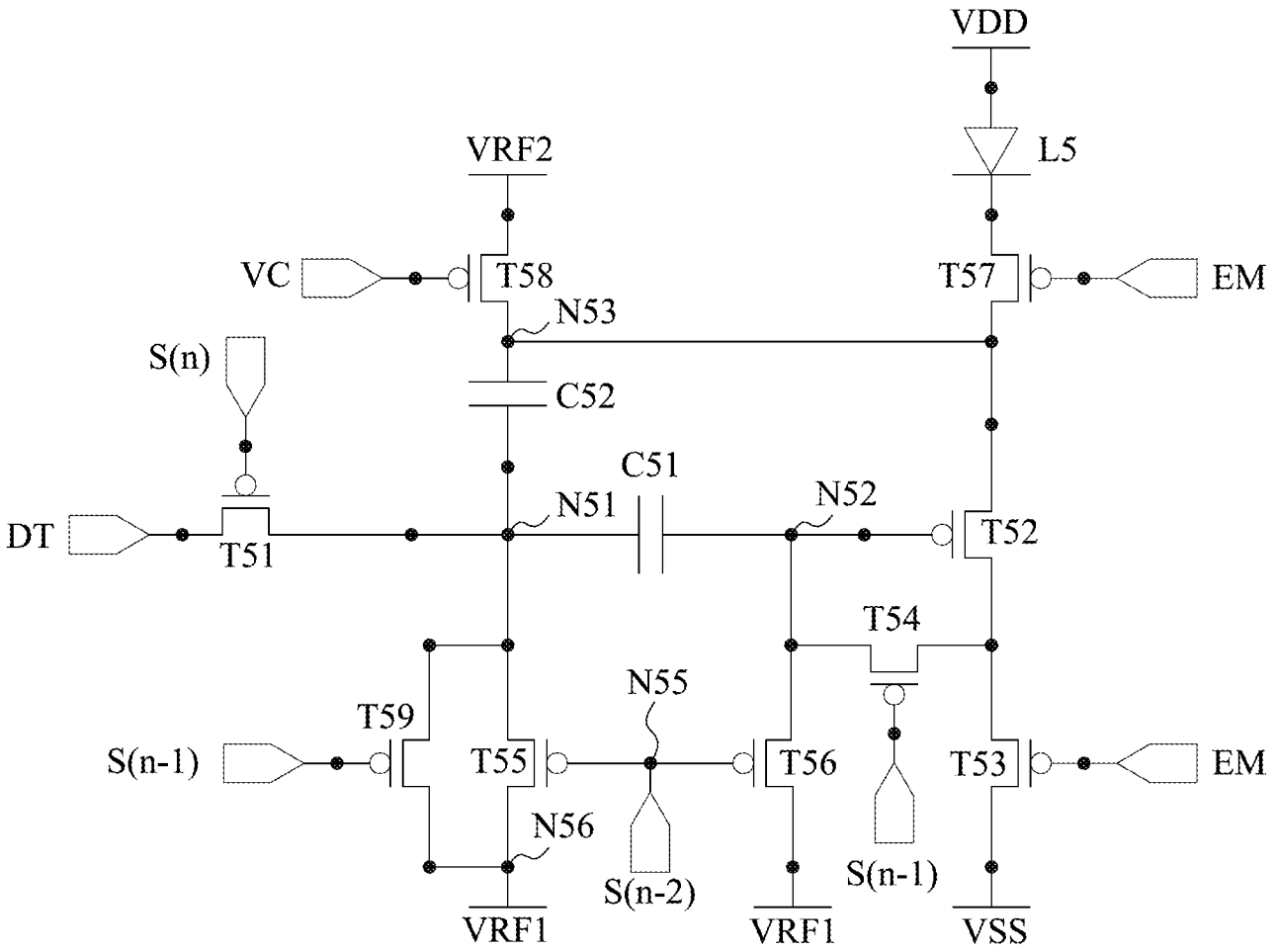
FIG. 5 is a circuit diagram of the pixel driving circuit in the display device according to one embodiment of this disclosure.

FIG. 5 is a circuit diagram of the pixel driving circuit 500 in the display device 110 according to one embodiment of this disclosure. The pixel driving circuit 500 is an embodiment of the pixel driving circuit 112 in the display device 110. The pixel driving circuit 500 is an alternative embodiment of the pixel driving circuit 200 illustratively shown in FIG. 2.

As illustratively shown in FIG. 5, the pixel driving circuit 500 includes switches T51-T59, capacitors C52, C51 and a light emitting element L5. Referring to FIG. 2 and FIG. 5, the configuration of the pixel driving circuit 500 is similar to that of the pixel driving circuit 200, and thus similar aspects of the configuration are not repeated for brevity. The switches T51-T54, T56-T58, the capacitors C52, C51 and the light emitting element L5 correspond to the switches T21-T24, T26-T28, the capacitors C22, C21 and the light emitting element L2, respectively.

As illustratively shown in FIG. 5, control terminals of the switches T55 and T56 are coupled to a node N55, and configured to receive the scan signal S(n−2) at the node N55. A control terminal of the switch T59 is coupled to the node N55, and another terminal of the switch T59 is coupled to a node N56.

Referring to FIG. 3 and FIG. 5, in some embodiments, the pixel driving circuit 500 is configured to operate according to the timing diagram shown in FIG. 3. In the embodiments described above, the operations of the pixel driving circuit 500 are similar to the operations of the pixel driving circuit 200 according to the timing diagram shown in FIG. 3, and thus similar aspects of these operations are not repeated for brevity.

Referring to FIG. 3 and FIG. 5, during the period P32, the scan signal S(n−1) has the enable voltage level VGL, such that the switch T59 is turned on. At this time, the switch T59 provides the reference signal VRF1 to the node N51, such that the node N51 has the voltage level RF1.

During the period P33, when the switch T51 writes the data signal DT into the node N51, the capacitor C51 writes the voltage level difference between the voltage levels RF1 and VDT into the node N52 to perform the data writing operation.

Referring to FIG. 2, FIG. 3 and FIG. 5, the operations of the pixel driving circuit 500 during the periods P31, P33 and P34 are similar to the operations of the pixel driving circuit 200 during the periods P31, P33 and P34, and thus similar aspects of these operations are not repeated for brevity.

Figure 6:
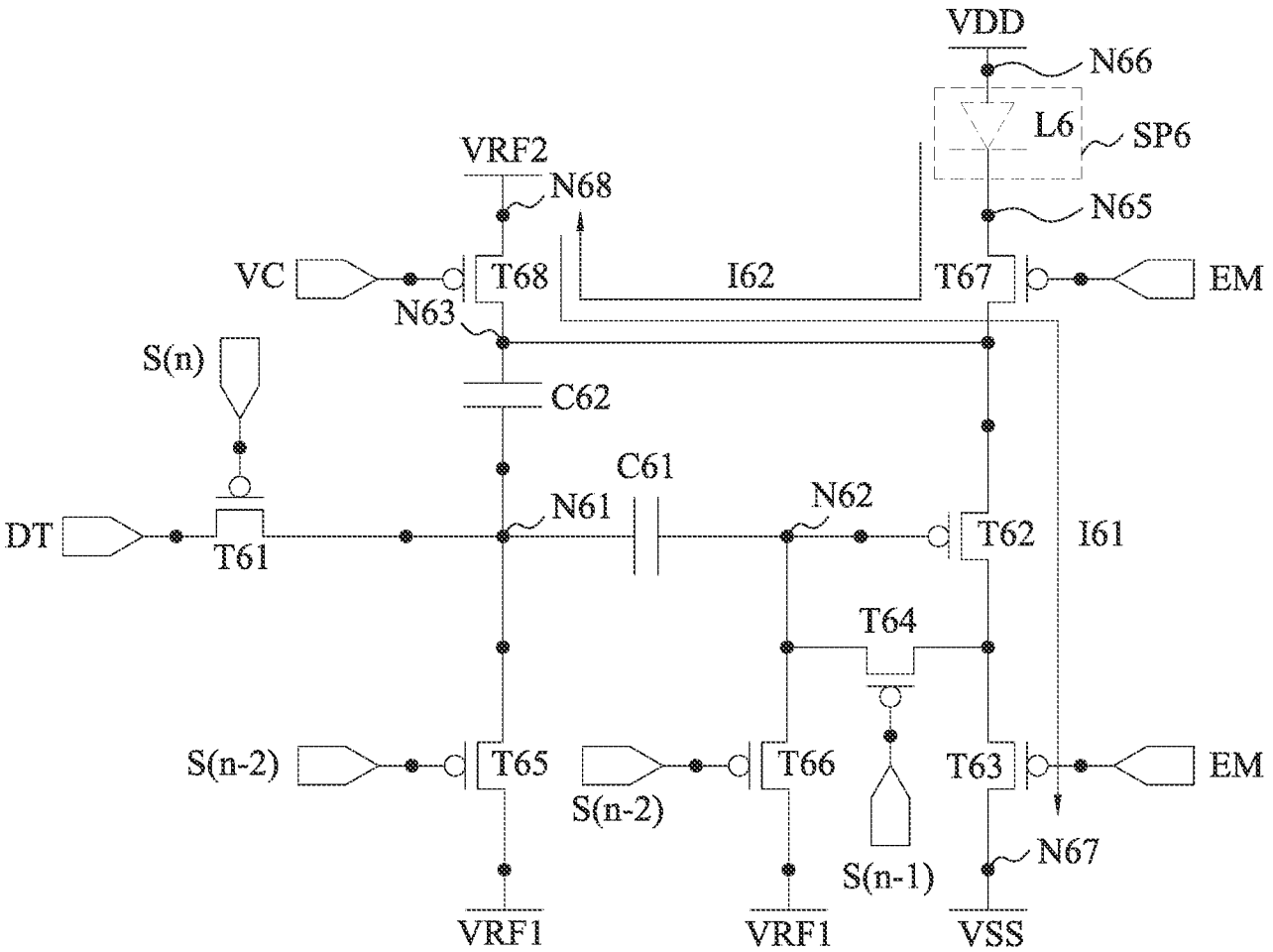
FIG. 6 is a circuit diagram of the pixel driving circuit in the display device according to one embodiment of this disclosure.

FIG. 6 is a circuit diagram of the pixel driving circuit 600 in the display device 110 according to one embodiment of this disclosure. The pixel driving circuit 600 is an embodiment of the pixel driving circuit 112 in the display device 110. The pixel driving circuit 600 is an alternative embodiment of the pixel driving circuit 200 illustratively shown in FIG. 2.

As illustratively shown in FIG. 6, the pixel driving circuit 600 includes switches T61-T68, and capacitors C62 and C61. Referring to FIG. 2 and FIG. 6, the configuration of the pixel driving circuit 600 is similar to that of the pixel driving circuit 200, and thus similar aspects of the configuration are not repeated for brevity. The switches T61-T68, and the capacitors C62 and C61 correspond to the switches T21-T28, and the capacitors C22 and C21, respectively. The differences between the pixel driving circuits 600 and 200 include that the pixel driving circuit 600 does not include the light emitting element L2, and the pixel driving circuit 600 includes an accommodating space SP6 positioned between the nodes N65 and N66. The accommodating space SP6 may be configured to accommodate a light emitting element L6 after detection (such as a detecting operation shown in FIG. 7), such that the light emitting element L6 is coupled to the pixel driving circuit 600.

Figure 7:
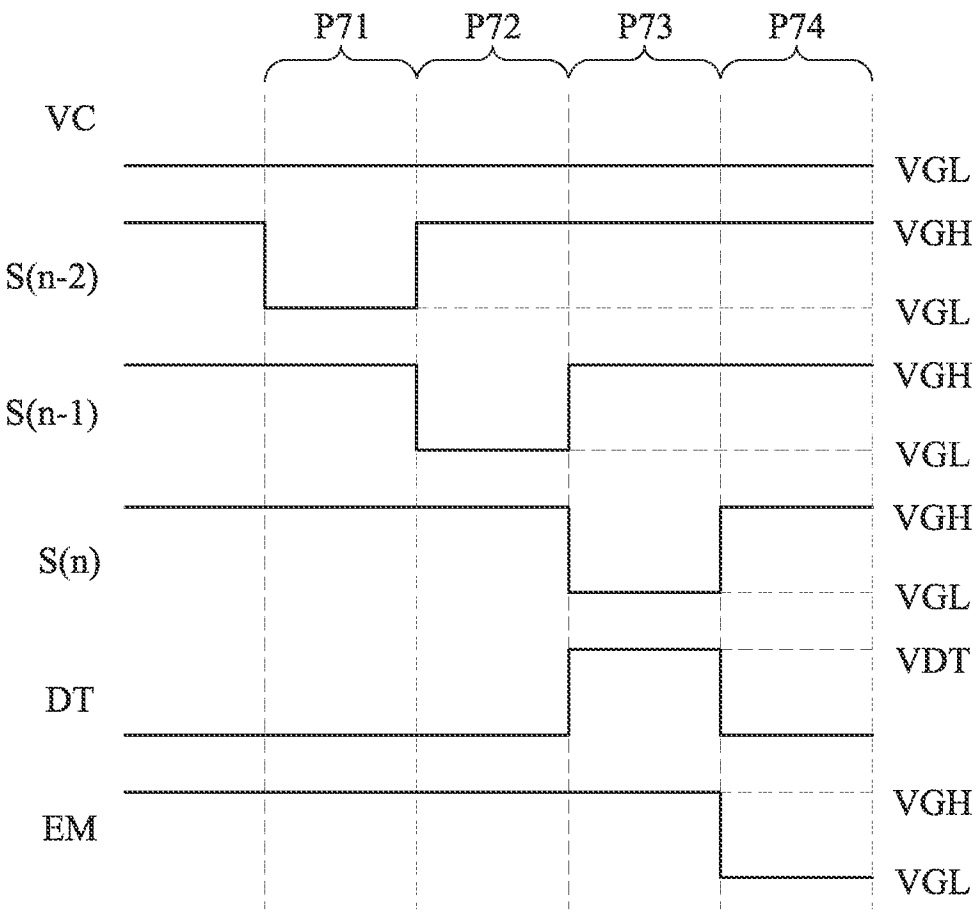
FIG. 7 is a timing diagram of the pixel driving circuit performing a detecting operation according to one embodiment of this disclosure.

FIG. 7 is a timing diagram of the pixel driving circuit 600 performing a detecting operation according to one embodiment of this disclosure. The timing diagram illustratively shown in FIG. 7 includes periods P71-P74 in order. Signal operations of the periods P71-P74 are similar to those of the periods P31-P34 shown in FIG. 3, and thus similar aspects of these operations are not repeated for brevity.

Referring to FIG. 6 and FIG. 7, during the period P71, the scan signal S(n−2) and the control signal VC have the enable voltage level VGL, such that the switches T65, T66 and T68 are turned on, to reset voltage levels of nodes N61, N62 and N63 by the reference signals VRF1 and VRF2.

During the period P72, the scan signal S(n−1) and the control signal VC have the enable voltage level VGL, such that the switches T64 and T68 are turned on. The scan signal S(n−2) has a disable voltage level VGH, such that the switches T65 and T66 are turned off. At this time, the reference signal VRF2 passes through the switches T68, T62 and T64 in order, and is written into the node N62.

During the period P73, the scan signal S(n) and the control signal VC have the enable voltage level VGL, such that the switches T61 and T68 are turned on. The scan signal S(n−1) has a disable voltage level VGH, such that the switch T64 is turned off. The switch T68 provides the reference signal VRF2 to the node N63, and the switch T61 and the capacitor C61 write the data signal DT into the node N62.

During the period P74, the light emitting signal EM and the control signal VC have the enable voltage level VGL, such that the switches T63 and T68 are turned on. At this time, a current 161 flows through the switches T68, T62 and T63 in order, to the node N67. In some embodiments, the user measures the current 161 at the node N67 to detect whether at least one of the switches T61-T68 operates normally.

For example, when each of the switches T61-T68 operates normally, the current level of the current 161 is proportional to the voltage level VDT of the data signal DT. In contrast, when the switch T61 cannot be turned on normally, the data signal DT cannot be written into the pixel driving circuit 600, such that the current level of the current 161 does not correspond to the voltage level VDT. As another example, when at least one of the switches T68, T62 and T63 cannot be turned on normally, the current 161 cannot flow to the node N67, such that the user cannot measure the current 161 at the node N67. In summary, the user can determine that the pixel driving circuit 600 is abnormal when the current 161 is abnormal. The present disclosure is not limited to the embodiments described above. In different embodiments, the user can measure different current flowing through the switches T61-T68 during different period(s) of the periods P71-P74, to detect whether the switches T61-T68 operate normally.

In some embodiments, after the user measures the current 161 to ensure that the pixel driving circuit 600 operates normally, the user couples the light emitting element L6 to the accommodating space SP6. In some embodiments, after the light emitting element L6 is coupled to the pixel driving circuit 600 at the accommodating space SP6, the user can further determine whether the light emitting element L6 operates normally.

For example, after the light emitting element L6 is coupled to the accommodating space SP6, the light emitting signal EM and the control signal VC have the enable voltage level VGL, such that the switches T68 and T67 are turned on. The light emitting element L6 receives the voltage signal VDD at the node N66, and the switch T68 receives the reference signal VRF2 at the node N68. At this time, a current 162 flows through the light emitting element L6, and the switches T67 and T68 in order. When the light emitting element L6, and the switches T67 and T68 operate normally, the brightness of the light emitting element L6 is proportional to a voltage level difference between the voltage signal VDD and the reference signal VRF2. In contrast, when at least one of the light emitting element L6, and the switches T67 and T68 is abnormal, the light emitting element L6 cannot emit light normally.

In some previous approaches, when a determination is made that the pixel driving circuit is abnormal, the light emitting element is already coupled to the pixel driving circuit. Accordingly, the manufacturing cost of the pixel driving circuit includes the manufacturing cost of the light emitting element.

Compared to the above approaches, in some embodiments of the present disclosure, a method of detecting the switches T61-T68 before the light emitting element L6 is coupled to the pixel driving circuit 600 is provided, as illustratively shown in FIG. 6 and FIG. 7. The detection is performed before the light emitting element L6 is coupled to the pixel driving circuit 600, such that the manufacturing cost of the pixel driving circuit 600 is ultimately reduced.

Figure 8:
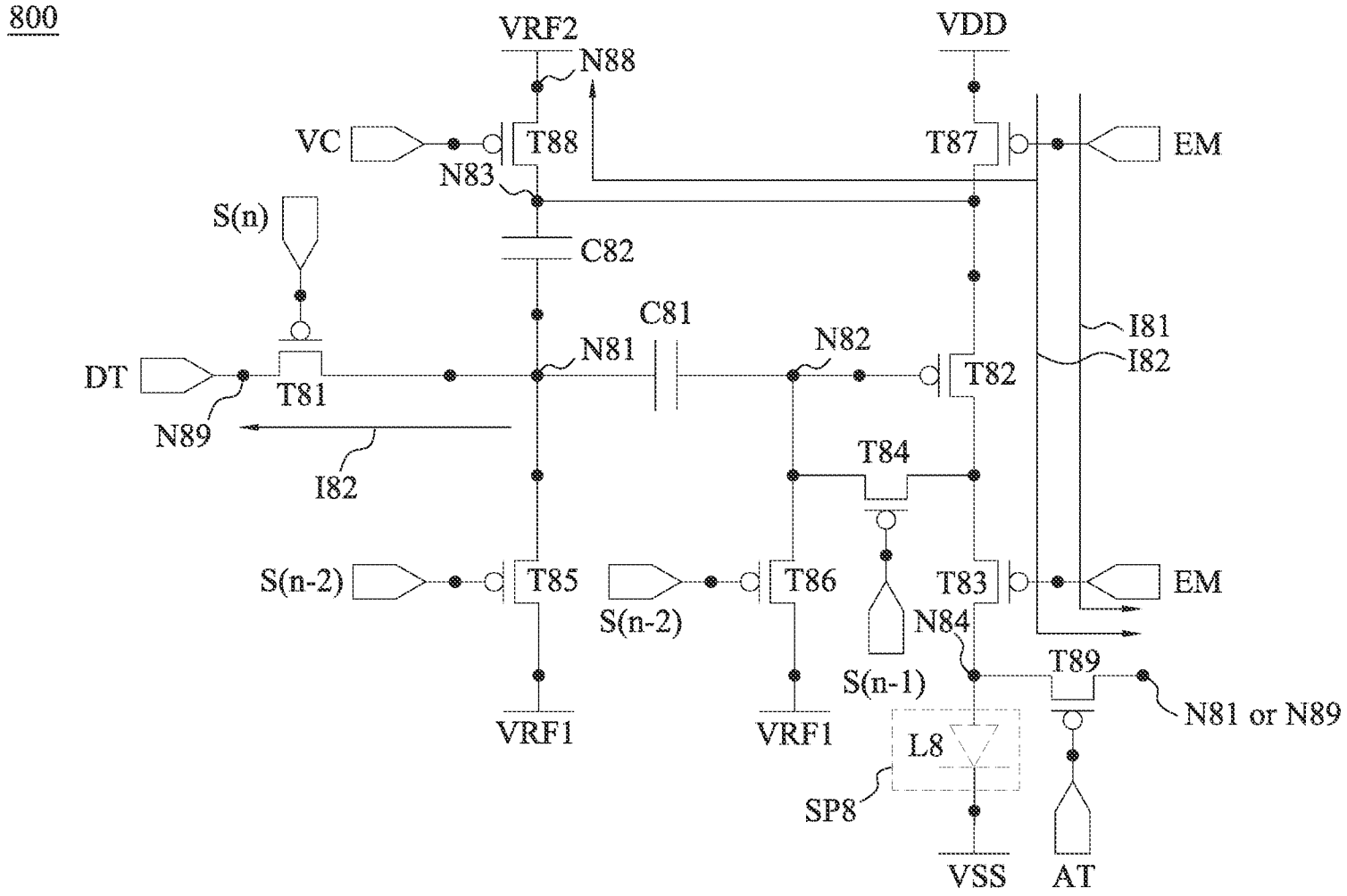
FIG. 8 is a circuit diagram of the pixel driving circuit in the display device according to one embodiment of this disclosure.

FIG. 8 is a circuit diagram of the pixel driving circuit 800 in the display device 110 according to one embodiment of this disclosure. The pixel driving circuit 800 is an embodiment of the pixel driving circuit 112 in the display device 110. The pixel driving circuit 800 is an alternative embodiment of the pixel driving circuit 200 illustratively shown in FIG. 2.

As illustratively shown in FIG. 8, the pixel driving circuit 800 includes switches T81-T89, capacitors C82, C81 and an accommodating space SP8. Referring to FIG. 2 and FIG. 8, the configuration of the pixel driving circuit 800 is similar to that of the pixel driving circuit 200, and thus similar aspects of the configuration are not repeated for brevity. The switches T81-T88, and the capacitors C82 and C81 correspond to the switches T21-T28, and the capacitors C22 and C21, respectively.

As illustratively shown in FIG. 8, a control terminal of the switch T87 is configured to receive the light emitting signal EM, a terminal of the switch T87 is configured to receive the voltage signal VDD, and another terminal of the switch T87 is coupled to the switch T82 at the node N83. A terminal of the accommodating space SP8 is coupled to the switches T83 and T89 at the node N84. A control terminal of the switch T89 is configured to receive a voltage signal AT, a terminal of the switch T89 is coupled to the node N84, and another terminal of the switch T89 is coupled to the switch T81 at the node N81 or at the node N89.

Figure 9:
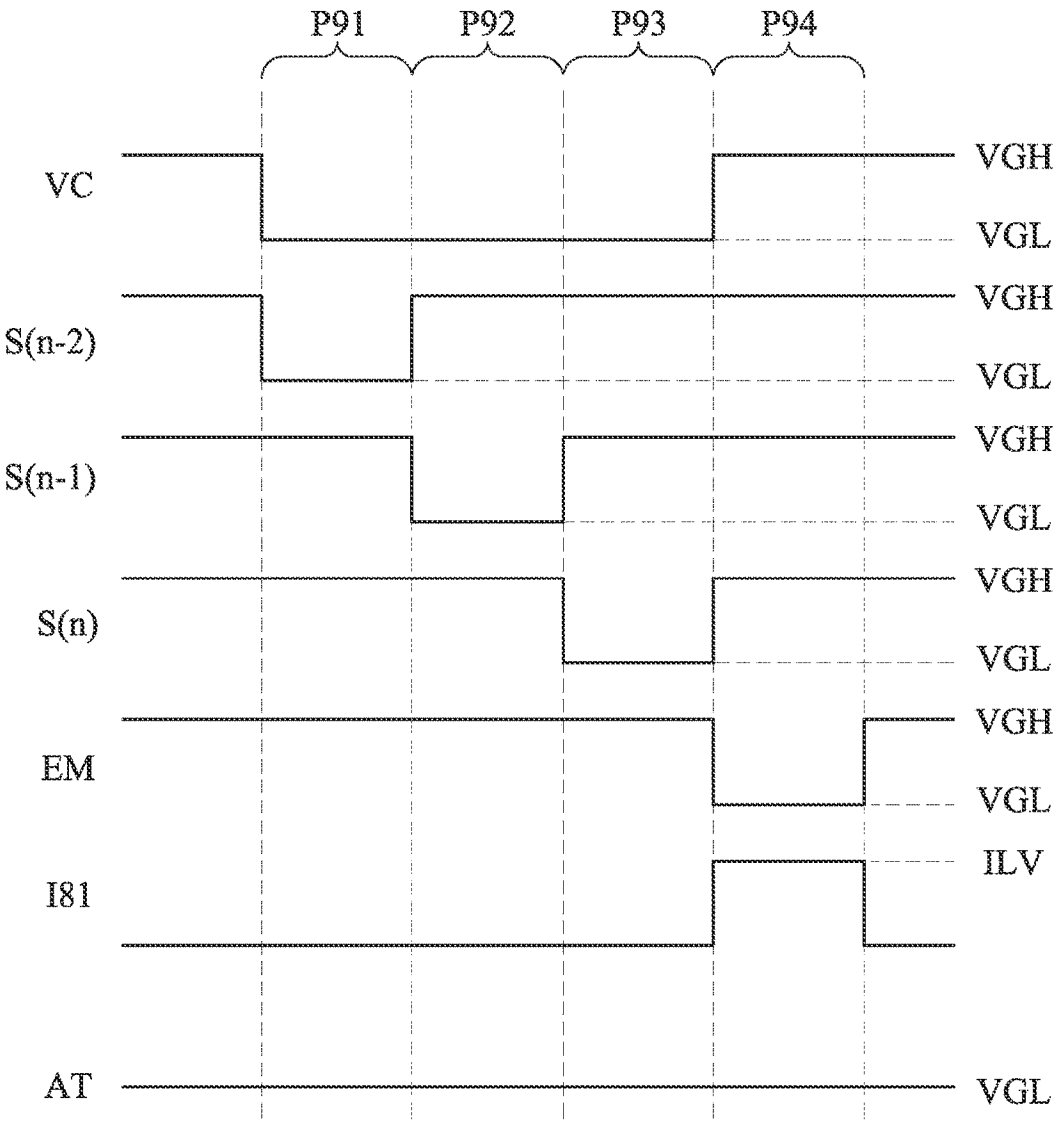
FIG. 9 is a timing diagram of the pixel driving circuit performing a detecting operation according to one embodiment of this disclosure.

FIG. 9 is a timing diagram of the pixel driving circuit 800 performing a detecting operation according to one embodiment of this disclosure. The timing diagram illustratively shown in FIG. 9 includes periods P91-P94 in order. Signal operations of the periods P91-P94 are similar to those of the periods P31-P34 shown in FIG. 3, and thus similar aspects of these operations are not repeated for brevity.

Referring to FIG. 8 and FIG. 9, during the period P91, the scan signal S(n−2) and the control signal VC have the enable voltage level VGL, such that the switches T85, T86 and T88 are turned on, to reset voltage levels of the nodes N81, N82 and N83 by the reference signals VRF1 and VRF2.

During the period P92, the scan signal S(n−1) and the control signal VC have the enable voltage level VGL, such that the switches T84 and T88 are turned on. The scan signal S(n−2) has a disable voltage level VGH, such that the switches T85 and T86 are turned off. At this time, the reference signal VRF2 passes through the switches T88, T82 and T84 in order, and is written into the node N82.

During the period P93, the scan signal S(n) and the control signal VC have the enable voltage level VGL, such that the switches T81 and T88 are turned on. The scan signal S(n−1) has a disable voltage level VGH, such that the switch T84 is turned off. At this time, the switch T88 provides the reference signal VRF2 to the node N83.

During the period P94, the light emitting signal EM and the voltage signal AT have the enable voltage level VGL, such that the switches T87, T83 and T89 are turned on. At this time, a current 181 flows through the switches T87, T82, T83 and T89 in order. In the embodiment corresponding to FIG. 9, the switch T89 is coupled to the node N89.

In some embodiments, the node N89 is coupled to a data line (not shown) configured to transmit the data signal DT. In some embodiments, the user can measure a current level ILV of the current 181 from the data line, and determine whether the pixel driving circuit 800 is abnormal according to the current level ILV. For example, when at least one of the switches T87, T82, T83 and T89 cannot be turned on normally, the current 181 cannot be transmitted to the node N89, such that the current level ILV measured from the data line is abnormal.

Figure 10:
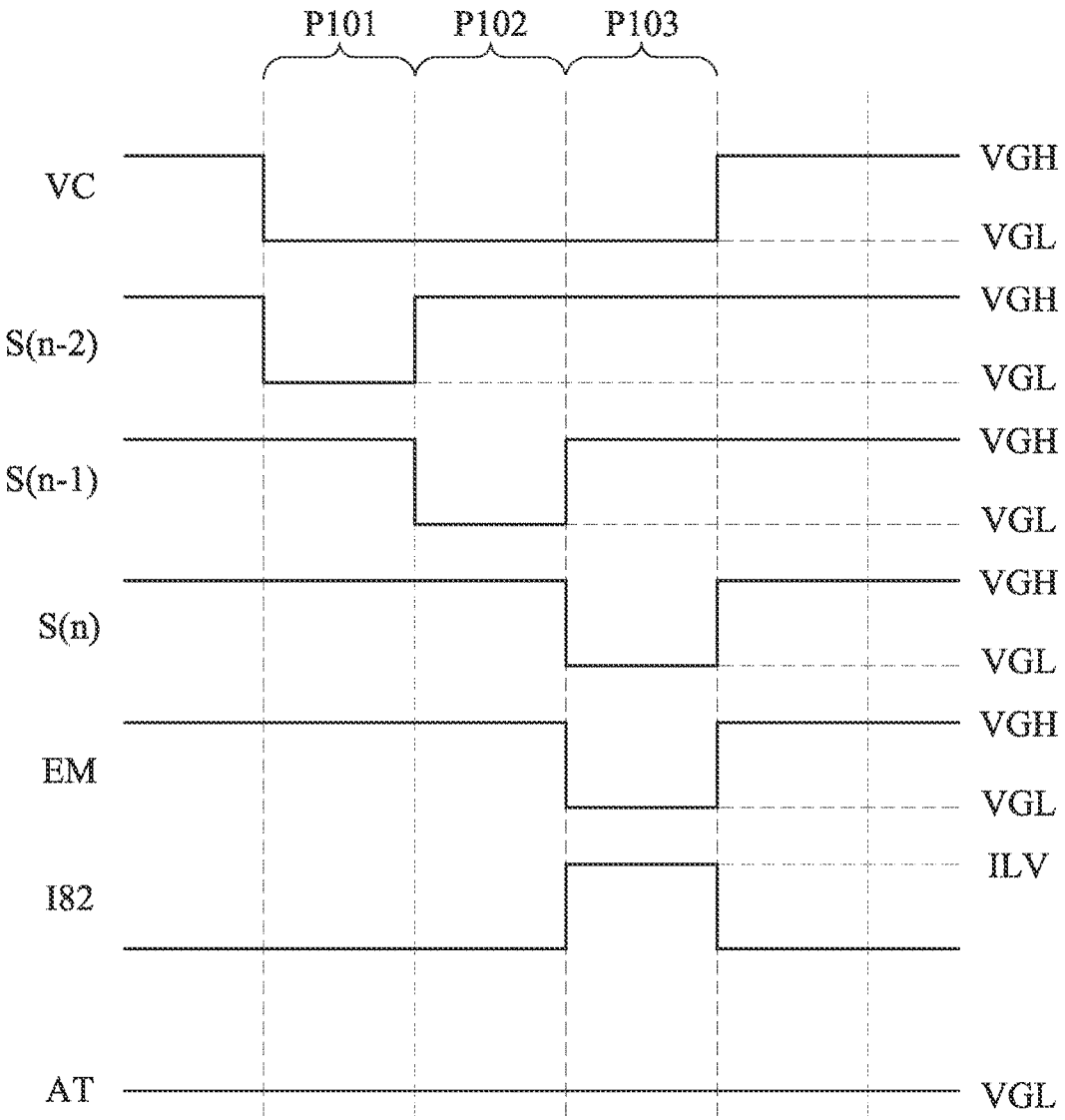
FIG. 10 is a timing diagram of the pixel driving circuit performing a detecting operation according to one embodiment of this disclosure.

FIG. 10 is a timing diagram of the pixel driving circuit 800 performing a detecting operation according to one embodiment of this disclosure. The timing diagram illustratively shown in FIG. 10 includes periods P101-P103 in order. Signal operations of the periods P101-P102 are similar to those of the periods P91-P92 shown in FIG. 9, and thus similar aspects of these operations are not repeated for brevity.

Referring to FIG. 8 and FIG. 10, during the period P103, the scan signal S(n), the voltage signal AT, the light emitting signal EM and the control signal VC have the enable voltage level VGL, such that the switches T81, T89, T87, T83 and T88 are turned on. At this time, a current 182 having the current level ILV flows through the switches T87, T82, T83 and T89 in order. In the embodiment corresponding to FIG. 10, the switch T89 is coupled to the node N81. After the current 182 flows through the switch T89 to the node N81, the current 182 further flows through the switch T81 to the node N89.

In some embodiments, the user can measure a current level ILV of the current 182 from the data line, and determine whether the pixel driving circuit 800 is abnormal according to the current level ILV. For example, when at least one of the switches T87, T82, T83, T89 and T81 cannot be turned on normally, the current 182 cannot be transmitted to the node N89, such that the current level ILV measured from the data line is abnormal.

In some embodiments, during the period P103, the current 182 further flows through the switches T87 and T88 in order, and flows to a node N88. The user can measure a current level ILV of the current 182 at the node N88, and determine whether the pixel driving circuit 800 is abnormal according to the current level ILV. For example, when at least one of the switches T87 and T88 cannot be turned on normally, the current 182 cannot be transmitted to the node N88, such that the current level ILV measured from the node N88 is abnormal.

In some embodiments, after the user measures the current 181 and/or 182 to ensure the pixel driving circuit 800 operates normally, the user couples the light emitting element L8 to the accommodating space SP8, such that a terminal of the light emitting element L8 is coupled to the node N84, and another terminal of the light emitting element L8 receives the voltage signal VSS. In some embodiments, after the light emitting element L8 is coupled to the pixel driving circuit 800, the pixel driving circuit 800 performs the light emitting operation according to the timing diagram shown in the FIG. 3.

The detecting method and light emitting method described above are illustrated as examples, and other types of detecting methods and light emitting methods are within the contemplated scope of the present disclosure.

In summary, in the embodiments of the present disclosure, when the light emitting element L2 or L5 emits light, compensation of the threshold voltage level $V_{TH}$ of the switch T22 or T25 is performed, such that the value of the threshold voltage level $V_{TH}$ does not affect the brightness of the light emitting element L2 or L5. The operations of compensating the threshold voltage level $V_{TH}$ can be turned on or turned off by adjusting the voltage level of the reference signal VRF2. Furthermore, the reference signals VRF1 and VRF2 are not affected by the voltage drop (IR drop), such that the brightnesses of the light emitting elements L2 and L5 are not affected by the internal resistance of the pixel driving circuit. In addition, the pixel driving circuits 600 and 800 can perform the detection with respect to the internal elements before coupling of the light emitting elements L6 and L8, such that the manufacturing costs are reduced.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device, comprising pixel driving circuits coupled to each other in series, one of the pixel driving circuits comprising:

a data writing unit configured to a write data signal into a first node, the data writing unit comprising:

a first capacitor, a first terminal of the first capacitor being coupled to the first node, and a second terminal of the first capacitor being coupled to a second node; and a second capacitor, a first terminal of the second capacitor being coupled to the first node;

a light emitting unit configured to generate a current according to the data signal, the light emitting unit comprising:

a first switch configured to receive the current, a control terminal of the first switch being coupled to the second node, and a first terminal of the first switch being coupled to a second terminal of the second capacitor; and a light emitting element configured to emit light according to the current;

a compensation unit configured to adjust a voltage level of the second node, the compensation unit comprising:

a second switch, a first terminal of the second switch being coupled to the second node, and a second terminal of the second switch being coupled to a second terminal of the first switch; and a third switch configured to provide a first reference signal to the second terminal of the second capacitor after the first node and the second node have a first voltage level and when the second switch is turned on.

2. The display device of claim 1, further comprising:

a fourth switch configured to be turned on during a first period, a first terminal of the fourth switch being coupled to the first node, and a second terminal of the fourth switch being configured to receive a first reference signal; and a fifth switch configured to be turned on during the first period, a first terminal of the fifth switch being coupled to the second node, and a second terminal of the fifth switch being configured to receive the first reference signal.

3. The display device of claim 2, wherein the fourth switch is further configured to be turned on during a second period after the first period, and the fifth switch is further configured to be turned off during the second period.

4. The display device of claim 2, wherein the pixel driving circuit further comprises:

a sixth switch configured to be turned on when the second switch is turned on, a first terminal of the sixth switch being coupled to the first node, and a second terminal of the sixth switch being coupled to the second terminal of the fourth switch.

5. The display device of claim 1, wherein the light emitting unit further comprises:

a fourth third switch configured to be turned on according to a light emitting signal, a first terminal of the fourth switch being coupled to the second terminal of the second capacitor; and a fifth switch configured to be turned on according to the light emitting signal, a first terminal of the fifth switch being coupled to the second terminal of the first switch.

6. The display device of claim 5, wherein the light emitting unit further comprises:

a sixth switch, a first terminal of the sixth switch being coupled to a second terminal of the fifth switch, wherein the light emitting element is coupled to the first terminal of the sixth switch.

7. The display device of claim 6, wherein the data writing unit further comprises:

a seventh switch, a first terminal of the seventh switch being coupled to the first node, and a second terminal of the seventh switch being configured to receive the data signal, wherein a second terminal of the sixth switch is coupled the seventh switch.

8. The display device of claim 7, wherein the second terminal of the sixth switch is coupled to the first terminal of the seventh switch.

9. The display device of claim 7, wherein the second terminal of the sixth switch is coupled to the second terminal of the seventh switch.

10. The display device of claim 1, wherein the third switch is configured to provide a first reference signal to the second terminal of the second capacitor, to write a threshold voltage level of the first switch into the second node, wherein a voltage level of the first reference signal is higher than the first voltage level.

11. The display device of claim 1, wherein a voltage level of the first reference signal is lower than or equal to the first voltage level.

12. The display device of claim 1, wherein the pixel driving circuit further comprises:

a fourth switch configured to provide a first reference signal to the second terminal of the second capacitor before the light emitting element is coupled the pixel driving circuit, to detect whether at least one of the first switch and the second switch operates normally; and an accommodating space configured to accommodate the light emitting element after operations of the first switch and the second switch are detected, to couple the light emitting element and the pixel driving circuit.

13. A pixel driving circuit, comprising:

a first capacitor, a first terminal of the first capacitor being coupled to a first node, and a second terminal of the first capacitor being coupled to a second node;

a second capacitor, a first terminal of the second capacitor being coupled to the first node;

a first switch configured to receive a current, a control terminal of the first switch being coupled to the second node, and a first terminal of the first switch being coupled to a second terminal of the second capacitor;

a light emitting element configured to emit light according to the current;

a second switch, a first terminal of the second switch being coupled to the second node, and a second terminal of the second switch being coupled to a second terminal of the first switch;

a third switch, a control terminal of the third switch being configured to receive a first scan signal, a first terminal of the third switch being coupled to the first node, and a second terminal of the third switch being configured to receive a first reference signal; and a fourth switch, a control terminal of the fourth switch being configured to receive a second scan signal different from the first scan signal, a first terminal of the fourth switch being coupled to the first node, and a second terminal of the fourth switch being coupled to the second terminal of the third switch.

14. The pixel driving circuit of claim 13, further comprising:

a fifth switch, a control terminal of the fifth switch being configured to receive the first scan signal, and a first terminal of the fifth switch being coupled to the second node, wherein second terminals of the fifth switch and the third switch are configured to receive a reference signal.

15. The pixel driving circuit of claim 13, further comprising:

a fifth switch, a first terminal of the fifth switch being coupled to the second terminal of the first switch; and a sixth switch, a first terminal of the sixth switch being coupled to a second terminal of the fifth switch, wherein the light emitting element is coupled to the second terminal of the fifth switch.

16. The pixel driving circuit of claim 15, further comprising:

a seventh switch, a first terminal of the seventh switch being coupled to the first node, and a second terminal of the seventh switch being configured to receive a data signal associated with the current, wherein a second terminal of the sixth switch is coupled to one of the first terminal of the seventh switch and the second terminal of the seventh switch.

17. The pixel driving circuit of claim 15, further comprising:

a seventh switch, a first terminal of the seventh switch being coupled to the second terminal of the second capacitor, wherein the light emitting element is configured to emit light when the fifth switch and the seventh switch are turned on.

18. A pixel driving circuit, comprising:

a first capacitor, a first terminal of the first capacitor being coupled to a first node, and a second terminal of the first capacitor being coupled to a second node;

a second capacitor, a first terminal of the second capacitor being coupled to the first node;

a first switch, a control terminal of the first switch being coupled to the second node, and a first terminal of the first switch being coupled to a second terminal of the second capacitor;

a second switch, a first terminal of the second switch being coupled to the second node, and a second terminal of the second switch being coupled to a second terminal of the first switch;

a third switch, a first terminal of the third switch being coupled to the first node;

a fourth switch, a first terminal of the fourth switch being coupled to the second node;

a fifth switch, a first terminal of the fifth switch being coupled to the second terminal of the second capacitor; and a sixth switch, a first terminal of the sixth switch being coupled to the second terminal of the first switch.

19. The pixel driving circuit of claim 18, wherein:

the third switch and the fourth switch are configured to turned on according to a scan signal;

second terminals of the third switch and the fourth switch are configured to receive a reference signal; and the fifth switch and the sixth switch are configured to be turned on according to a light emitting signal.

20. The pixel driving circuit of claim 19, further comprising:

a seventh switch, a first terminal of the seventh switch being coupled to the first node, and a second terminal of the seventh switch being coupled to a second terminal of the sixth switch; and a light emitting element coupled to the second terminal of the seventh switch.

* * * * *